United States Patent [19]

Baldwin

[11] 4,162,958

[45] Jul. 31, 1979

[54] PROCESS FOR THE DISCHARGE OF ASH CONCENTRATE FROM A COAL DEASHING SYSTEM

[75] Inventor: Roger A. Baldwin, Warr Acres, Okla.

[73] Assignee: Kerr-McGee Corporation, Oklahoma City, Okla.

[21] Appl. No.: 888,104

[22] Filed: Mar. 20, 1978

[51] Int. Cl.[2] ..... C10G 1/00

[52] U.S. Cl. ..... 208/8 LE; 208/177

[58] Field of Search ..... 208/8 LE

[56] References Cited

U.S. PATENT DOCUMENTS

| | | | |
|---|---|---|---|
| 2,476,999 | 7/1949 | Orchin | 208/8 LE |
| 3,375,188 | 3/1968 | Bloomer | 208/8 LE |
| 3,379,638 | 4/1968 | Bloomer et al. | 208/8 LE |
| 3,852,183 | 12/1974 | Snell | 208/10 |
| 4,090,958 | 5/1978 | Leonard | 208/8 LE X |

*Primary Examiner*—Delbert E. Gantz
*Assistant Examiner*—William G. Wright
*Attorney, Agent, or Firm*—William G. Addison

[57] ABSTRACT

An improved process for the continuous discharge from a first separation zone of a first heavy fraction comprising insoluble coal products and solvent in a coal deashing process utilizing solvents at elevated pressures and temperatures near the critical temperature of the solvent. The continuous discharge of the insoluble coal products in a dry, powdery form, is achieved by monitoring the temperature level of the solvent and insoluble coal products within a transfer conduit after withdrawal and pressure reduction from the first separation zone operating pressure, at a temperature below about 550 degrees F.

5 Claims, 1 Drawing Figure

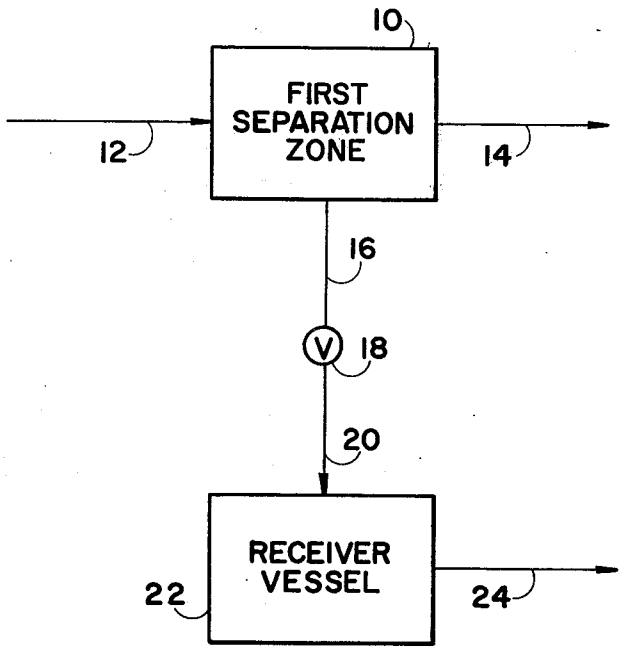
10
FIRST SEPARATION ZONE
12
14
16
V
18
20
RECEIVER VESSEL
22
24

PROCESS FOR THE DISCHARGE OF ASH CONCENTRATE FROM A COAL DEASHING SYSTEM

CROSS-REFERENCE TO RELATED APPLICATIONS

This application relates to applicants copending application Ser. No. 838,021 entitled "A Powdery Composition Comprising Coal Products And System For Producing Same In A Coal Deashing Process" filed Sept. 29, 1977.

BACKGROUND OF THE INVENTION

1. Field of the Invention

This invention relates to a process for producing a continuous discharge of insoluble coal products, in a dry powdery form, from a coal deashing system utilizing solvents at temperatures near the critical temperature of the solvent and at elevated pressures.

2. Description of the Prior Art

Various coal processing systems have been developed in the past wherein coal has been treated with one or more liquefaction solvents after which the liquefaction products are processed to separate the resulting insolubles from the soluble coal products.

In U.S. patent application Ser. No. 838,021 filed Sept. 27, 1977 and assigned to the same assignee as the present invention, an improved system for deashing coal liquefaction products, i.e., removing insolubles, is disclosed.

In that system, a feed mixture comprising soluble coal products, solvent and insoluble coal products is separated in a first separation zone maintained at an elevated temperature and pressure into a first heavy fraction comprising insoluble coal products and some of the solvent and a first light fraction. The insoluble coal products comprise the undissolved coal, mineral matter, other solid inorganic particulate matter and other such matter which is insoluble in the solvent solution under the operating conditions of the process.

The first heavy fraction is withdrawn from the first separation zone and the pressure level is reduced at least 100 psig and preferably at least about 500 psig to vaporize the solvent and yield the insoluble coal products in a dry, powdery form referred to as ash concentrate. The powdery ash concentrate composition can be made into aqueous slurries for use as a feed or transported by mechanical means such as, for example, screw feeders or pneumatically to subsequent processing equipment such as for example, gasifiers to recover hydrogen values.

Under certain conditions however, it has been found that the first heavy phase does not yield the desired, dry, powdery ash concentrate composition upon withdrawal and pressure reduction. Rather, the discharged first heavy fraction is in the form of large chunks or a continuous extrusion which plugs the transfer conduit from the first separation zone or the vessel to which the transfer conduit connects, such as for example, a solid-gas separator, such that the process operations must be terminated. Further, the plugs are hard to remove after formation in the transfer lines or vessels and require a tedious and expensive cleanout to restore operations.

Thus, it would be desirable to provide a method by which the plugging problem associated with the withdrawal of the first heavy fraction from the first separation zone could be alleviated.

SUMMARY OF THE INVENTION

It has been discovered that the recovery of the first heavy fraction comprising insoluble coal products from the first separation zone in a coal deashing process utilizing solvent at elevated pressures and temperatures near the critical temperature of the solvent, as a dry, powdery composition in a continuous manner is at least partially dependent upon the temperature of the ash concentrate composition and the solvent within the transfer conduit after withdrawal from the first separation zone and pressure reduction. If the temperature level of the discharging first heavy fraction is too high, plugging of the pressure reduction means, transfer line and ash concentrate receiver vessel may result.

To alleviate the tendency of the ash concentrate composition to plug the pressure reduction means, transfer conduit and receiver vessel, it has been discovered that the temperature level of the mixture of ash concentrate and solvent, after pressure reduction, should be below about 550 degrees F. within the transfer conduit and receiver. The result of reducing the temperature of the discharged first heavy fraction below 550 degrees F. is the continuous production of a dry, powdery, ash concentrate composition.

DESCRIPTION OF THE SINGLE FIGURE

The single FIGURE is a schematic, diagrammatic illustration of the process of this invention.

DESCRIPTION OF THE PREFERRED EMBODIMENT

In the practice of the invention disclosed in U.S. patent application Ser. No. 838,021, filed Sept. 27, 1977, the disclosure of which is incorporated herein by reference, a feed mixture (comprising soluble coal products, insoluble coal products and a solvent) is passed from a mixing zone through a conduit into a first separation zone maintained at an elevated temperature and pressure. In the first separation zone, the feed mixture is separated into a first heavy fraction and a first light fraction. The first light fraction is withdrawn and passed into a second separation zone. The first heavy fraction is withdrawn from the first separation zone and the pressure is reduced at least 100 psig to yield the dry, powdery ash concentrate composition.

Turning to the drawing, in accordance with the present invention, a feed mixture (comprising soluble coal products, insoluble coal products and a solvent) enters a first separation zone 10 by a conduit 12. Sufficient solvent is present in the feed mixture to provide a ratio by weight of solvent to soluble coal products and insoluble coal products of from about 1:1 to about 10:1. It is to be understood that larger quantities of solvent can be present, however such quantities are not required.

The temperature level in the first separation zone 10 is maintained at a temperature level in the range of from about 400 degrees F. to about 700 degrees F. and at a pressure level in a range of from about 700 psig to about 1000 psig to effect a separation. Preferably, the first separation zone 10 is maintained at a temperature level in the range of from about 400 degrees F. to about 650 degrees F. and the pressure level is maintained in a range of from about 800 psig to about 950 psig.

In the first separation zone 10, the feed mixture separates into a first light fraction comprising soluble coal products and solvent and a first heavy fraction comprising insoluble coal products and some solvent.

The first light fraction is withdrawn from the first separation zone 10 by a conduit 14 to enter subsequent processing equipment (not shown).

The first heavy fraction is withdrawn from the first separation zone through a conduit 16 and is passed through a pressure reduction means 18, such as for example, a pressure reduction value or flash vessel. During the passage of the first heavy fraction through the pressure reduction means 18, the pressure level of the first heavy fraction is reduced at least 100 psig. Preferably, the pressure level of the first heavy fraction is reduced at least 500 psig. The pressure reduction flashes the first heavy fraction to form one stream comprising the solvent and one stream comprising the insoluble coal products now referred to as ash concentrate which pass together through a transfer conduit 20 to enter a receiver vessel 22. The ash concentrate is collected in receiver vessel 22 and the solvent is withdrawn from vessel 22 by a conduit 24 for reutilization in preparing additional feed mixture.

The distance traversed by conduits 16 and 20 can be minimal or, the length of either or both of the conduits 16 and 20 can be substantial, that is, over several feet.

In some instances, it has been found that the first heavy fraction has a tendency upon pressure reduction by pressure reduction means 18 not to yield the preferred dry, powdery ash concentrate composition. Instead, the first heavy fraction was discharged from the pressure reduction means 18 in the form of large chunks or as a continuous extrusion which can plug the transfer conduit 20 or the receiver vessel 22 or pressure reduction means 18. The plugging results in the termination of the discharge of the first heavy fraction from the first separation zone 10 and may result in the ultimate termination of the deashing process operation.

It now has been discovered that the discharge of the first heavy fraction from the first separation zone can be achieved in a continuous manner, when it would otherwise plug, by reducing the temperature level of the discharged ash concentrate and solvent in the transfer conduit 20 and receiver vessel 22 to a temperature below about 550 degrees F. The result of controlling the temperature of the discharged first heavy fraction as well as providing the pressure reduction of at least 100 psig is a continuous discharge of a dry, powdery ash concentrate composition from the first separation zone 10.

The temperature of the discharged first heavy phase may be controlled by maintaining the temperature level in the first separation zone 10 below about 550 degrees F. Alternatively, the temperature level of the discharged first heavy phase may be controlled by regulation of the extent of pressure reduction, upon passage through pressure reduction means 18, to effect flash cooling of the heavy phase to a temperature level below about 550 degrees F. through controlled flashing of the solvent contained therein.

The effect of controlling the temperature to maintain the temperature of the discharged first heavy fraction below about 550 degrees F. can be more clearly seen by reference to Table I. In Table I, the results of the discharge of the first heavy fraction utilizing different process conditions are set forth. The feed mixture introduced into the first separation zone 10 comprises coal liquefaction products (soluble coal products and insoluble coal products) derived from Pittsburgh #8 coal and solvent (comprising benzene). The benzene is present in the feed mixture in a ratio by weight of benzene to soluble coal products and insoluble coal products of about 2:1.

TABLE I

| | First Separation Zone | | Transfer Conduit 20 | Comments on Discharged |
|---|---|---|---|---|
| Test No. | Temperature, °F. | Pressure, psig | Temperature, °F. | First Heavy Fraction |
| 1. | 525–540 | 700–1000 | 540–565 | 79% + 16 mesh; some 1–2 inch solid lumps |
| 2. | 470–475 | 700–1000 | 500–530 | 96.1% −16 mesh; no lumps, no discharge problems |
| 3. | 545–560 | 700–1000 | 560–585 | 100% + 16 mesh; receiver plugged |
| 4. | 605–535 | 700–1000 | 520–560 | 78% +16 mesh; some 1–2 inch solid lumps |
| 5. | 545–560 | 700–1000 | 600–610 | Transfer line plugged on first discharge |
| 6. | 545–560 | 700–1000 | 500–470 | 97% −16 mesh; no discharge problems |

The test results set forth in Table I clearly demonstrate the effect temperature has upon the discharged first heavy fraction in transfer conduit 20. If the temperature of the discharged first heavy fraction is too high, the transfer conduit 20, pressure reduction means 18 and receiver vessel 22 all can be plugged.

The term "insoluble coal products" as used herein refers to the undissolved coal, mineral matter, other solid inorganic particulate matter and other such matter in the feed mixture which is insoluble in the solvent under the operating conditions of the process of this invention.

The term "ash concentrate" refers to the insoluble coal product composition which has been separated from the soluble coal products and the solvent removed therefrom.

The term "solvent" as used herein means at least one light organic solvent consisting essentially of at least one substance having a critical temperature below 800 degrees F. selected from the group consisting of aromatic hydrocarbons having a single benzene nucleus and normal boiling points below about 310 degrees F., cycloparaffin hydrocarbons having normal boiling points below about 310 degrees F., open chain monoolefin hydrocarbons having normal boiling points below about 310 degrees F., open chain saturated hydrocarbons having normal boiling points below about 310 degrees F., mono-, di, and tri-open chain amines containing from about 2–8 carbon atoms, carbocyclic amines having a monocyclic structure containing from about 6–9 carbon atoms, heterocyclic amines containing from about 5–9 carbon atoms, and phenols containing from about 6–9 carbon atoms and their homologs.

While the present invention has been described with respect to what at present is considered to be the preferred embodiment thereof, it is to be understood that changes or modifications can be made in the process or apparatus without departing from the spirit or scope of the invention as defined by the following claims.

What is claimed is:

1. In a process for separating a feed mixture comprising soluble coal products, insoluble coal products and a solvent in a separation zone, said solvent consisting essentially of at least one substance having a critical temperature below 800 degrees F. selected from the group consisting of aromatic hydrocarbons having a single benzene nucleus and normal boiling points below about 310 degrees F., cycloparaffin hydrocarbons having normal boiling points below about 310 degrees F., open chain mono-olefin hydrocarbons having normal boiling points below about 310 degrees F., open chain saturated hydrocarbons having normal boiling points below about 310 degrees F., mono-, di, and tri-open chain amines containing from about 2–8 carbon atoms, carbocyclic amines having a monocyclic structure containing from about 6–9 carbon atoms, heterocyclic amines containing from about 5–9 carbon atoms, and phenols containing from about 6–9 carbon atoms and their homologs, in which said feed mixture is maintained in said separation zone at an elevated temperature and pressure to separate said feed mixture into a light fraction and into a heavy fraction comprising insoluble coal products and some solvent and in which withdrawing said heavy fraction from said separation zone and reducing the pressure level of said heavy fraction at least about 100 psig fails to yield a dry, powdery, ash concentrate composition, the improvement which comprises:

reducing the temperature level of the heavy fraction after pressure reduction to a temperature level below about 550 degrees F. to continuously yield a dry, powdery, ash concentrate composition.

2. The process of claim 1 wherein the elevated temperature and pressure is defined further as:

a temperature level in the range of from about 400 degrees F. to about 700 degrees F. and a pressure level in the range of from about 700 psig to about 1000 psig.

3. The process of claim 2 wherein the temperature level is defined further as:

preferably a temperature level in the range of from about 400 degrees F. to about 650 degrees F.

4. The process of claim 1 wherein the pressure reduction is defined further as:

preferably reducing the pressure level of the heavy fraction at least about 500 psig.

5. The process of claim 1 wherein reducing the temperature level of the heavy fraction after pressure reduction is defined further as:

reducing the temperature level of the heavy fraction through controlled flash cooling of the heavy fraction during pressure reduction to a temperature level below about 550 degrees F.

* * * * *